US009188297B2

(12) United States Patent
Naganawa

(10) Patent No.: US 9,188,297 B2
(45) Date of Patent: Nov. 17, 2015

(54) AUTOMOTIVE HEADLAMP FORMING MULTIPLE LIGHT DISTRIBUTION PATTERNS WITH A SINGLE LAMP

(75) Inventor: Masahito Naganawa, Shizuoka (JP)

(73) Assignee: KOITO MANUFACTURING CO., LTD., Minato-Ku, Tokyo (JP)

( * ) Notice: Subject to any disclaimer, the term of this patent is extended or adjusted under 35 U.S.C. 154(b) by 63 days.

(21) Appl. No.: 13/368,179

(22) Filed: Feb. 7, 2012

(65) Prior Publication Data

US 2012/0201040 A1 Aug. 9, 2012

(30) Foreign Application Priority Data

Feb. 9, 2011 (JP) ..... 2011-026311

(51) Int. Cl.
*F21S 8/10* (2006.01)

(52) U.S. Cl.
CPC ..... *F21S 48/1159* (2013.01); *F21S 48/1104* (2013.01); *F21S 48/1154* (2013.01); *F21S 48/1358* (2013.01); *F21S 48/1747* (2013.01)

(58) Field of Classification Search
CPC . F21S 48/1159; F21S 48/145; F21S 48/1705; F21S 48/1168; F21S 48/1747
USPC ..... 362/516, 519, 538, 545
See application file for complete search history.

(56) References Cited

U.S. PATENT DOCUMENTS 6,644,828 B2 * 11/2003 Kinouchi ..... 362/214
7,150,553 B2 * 12/2006 English et al. ..... 362/545
7,156,544 B2 * 1/2007 Ishida ..... 362/538
7,249,877 B2 * 7/2007 Johnson et al. ..... 362/545
7,281,823 B2 * 10/2007 Moisel ..... 362/294
7,281,828 B2 * 10/2007 Steinhart et al. ..... 362/516
7,311,430 B2 * 12/2007 Tsukamoto et al. ..... 362/545
7,357,545 B2 * 4/2008 Stefka et al. ..... 362/539
7,600,894 B1 * 10/2009 Simon ..... 362/244

(Continued)

FOREIGN PATENT DOCUMENTS

CN 101016980 A 8/2007
CN 101235950 A 8/2008

(Continued)

OTHER PUBLICATIONS

Chinese First Office Action dated Dec. 31, 2013 issued in the corresponding Chinese Patent Application No. 2012100285420 and English language translation.

(Continued)

*Primary Examiner* — Jong-Suk (James) Lee
*Assistant Examiner* — Bryon T Gyllstrom
(74) *Attorney, Agent, or Firm* — Buchanan Ingersoll & Rooney PC

(57) ABSTRACT

A reflector includes a first reflector portion located above the central axis of a headlamp extending in the longitudinal direction of a vehicle, and a second reflector portion located below the central axis. A first light source and a second light source are arranged such that: the light emitted from the first light source is reflected by the first reflector portion to form a first light distribution pattern; and the light emitted from the second light source forms two partial light distribution patterns by being reflected with both the first reflector portion and the second reflector portion, and a second light distribution pattern, which is different from the first light distribution pattern, is formed by combining the two partial light distribution patterns.

5 Claims, 8 Drawing Sheets

(56) References Cited

U.S. PATENT DOCUMENTS

| | | | | |
|---|---|---|---|---|
| 7,748,879 | B2 * | 7/2010 | Koike et al. | 362/487 |
| 2002/0039289 | A1 | 4/2002 | Kinouchi | |
| 2005/0036332 | A1 * | 2/2005 | Steinhart et al. | 362/516 |
| 2009/0201693 | A1 * | 8/2009 | Chinniah et al. | 362/516 |
| 2010/0008088 | A1 * | 1/2010 | Koizumi et al. | 362/235 |

FOREIGN PATENT DOCUMENTS

| | | | | |
|---|---|---|---|---|
| EP | 2184532 | A2 * | 5/2010 | F21S 8/12 |
| JP | 2008-186773 | A | 8/2008 | |
| JP | 2008226706 | A | 9/2008 | |
| JP | 2009-193867 | A | 8/2009 | |
| JP | 2009-301980 | A | 12/2009 | |
| WO | 03/003410 | A1 | 1/2003 | |

OTHER PUBLICATIONS

Chinese Second Office Action dated Jul. 30, 2014 issued in the corresponding Chinese Patent Application No. 2012100285420 and English language translation (13 pages).

Notification of Reason(s) for Refusal dated Oct. 14, 2014 issued in the corresponding Japanese Patent Application No. 2011-026311 and English language translation (8 pages).

Office Action issued on Feb. 3, 2015, by the Chinese Patent Office in corresponding Chinese Patent Application No. 201210028542.0, and an English Translation of the Office Action. (18 pages).

Office Action issued on Apr. 7, 2015, by the Japanese Patent Office in corresponding Japanese Patent Application No. 2011-026311, and an English Translation of the Office Action. (7 pages).

* cited by examiner

FIG. 2
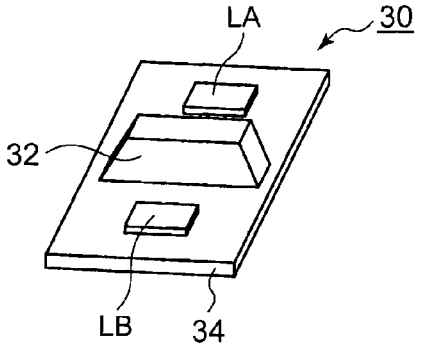
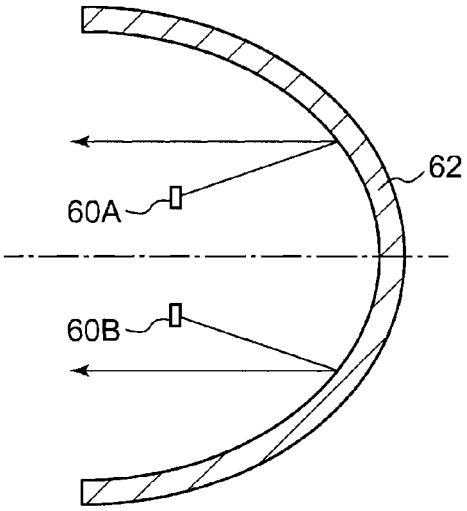
FIG. 3A
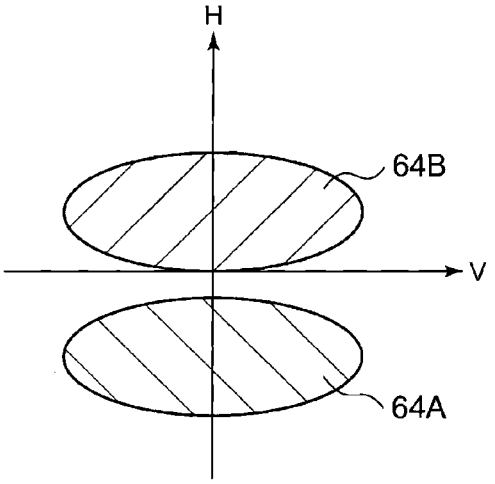
FIG. 3B

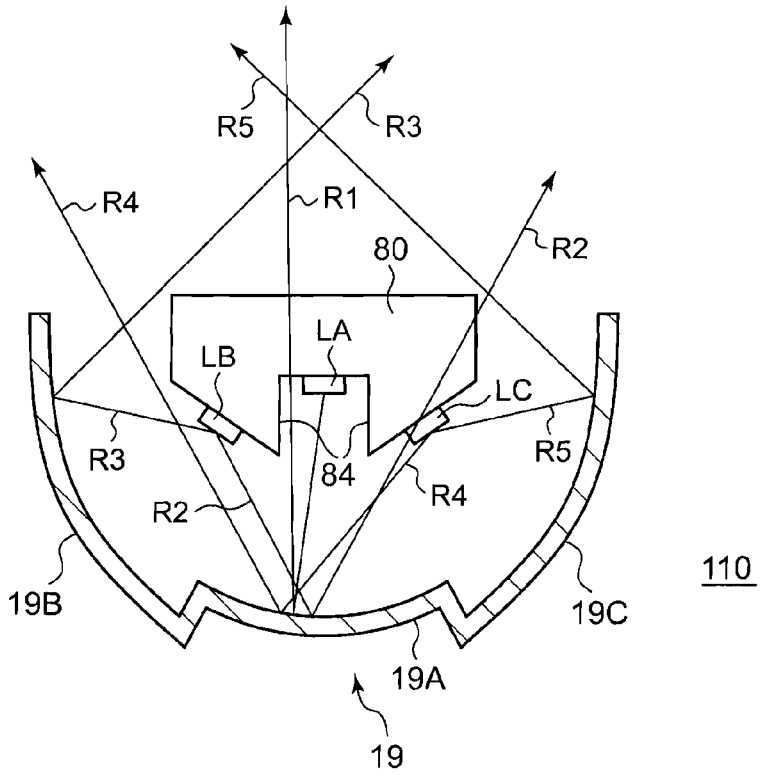
FIG. 9A
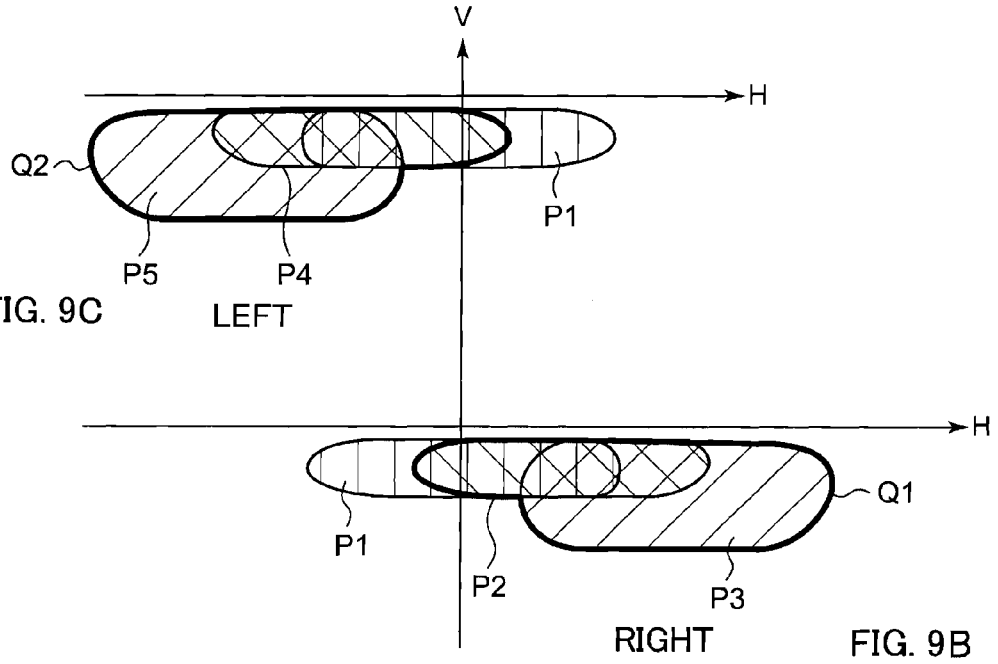
FIG. 9C
FIG. 9B

AUTOMOTIVE HEADLAMP FORMING MULTIPLE LIGHT DISTRIBUTION PATTERNS WITH A SINGLE LAMP

BACKGROUND OF THE INVENTION

1. Field of the Invention

The present invention in general relates to an automotive headlamp forming a plurality of light distribution patterns with a single lamp.

2. Description of the Related Art

Automotive headlamps are generally configured to switch a low beam and a high beam. The low beam is used for lighting a near region with a predetermined illuminance, and light distribution of the low beam is specified so as not to provide glare to oncoming vehicles and leading vehicles. The low beam is mainly used while a vehicle is running in an urban area. On the other hand, the high beam is used for lighting a forward wide range and a far region with a relatively high illuminance. The high beam is mainly used while a vehicle is running at high speed on a road where oncoming vehicles and leading vehicles are few.

In many cases, the automotive headlamps as described above are configured to select a plurality of light distribution patterns with one lamp. For example, an automotive headlamp is disclosed in Japanese Patent Application Publication No. 2008-226706, in which light distribution patterns different from each other are respectively formed on three reflective surfaces, each area of the surfaces having been formed into a radial shape in a reflector, by combining three semiconductor light emitting elements and the three reflective surfaces.

In the automotive headlamp described in the above patent application, it is needed to design a chamber dedicated for each combination of the semiconductor light emitting elements and the reflective surfaces. Accordingly, there is the problem that the structure of the automotive headlamp becomes complicated and the cost is increased.

SUMMARY OF THE INVENTION

The present invention has been made in view of these situations, and a purpose of the invention is to provide an automotive headlamp that has a simple and low-cost structure and is capable of forming a plurality of light distribution patterns with a single lamp.

An automotive headlamp according to an embodiment of the present invention comprises: a reflector composed of a first reflector portion and a second reflector portion; and a light source composed of a first light source and a second light source that are located at or near the focal point of the reflector. The first light source and the second light source are arranged such that: the light emitted from the first light source is reflected by the first reflector portion to form a first light distribution pattern; and the light emitted from the second light source forms two partial light distribution patterns by being reflected with both the first reflector portion and the second reflector portion, and a second light distribution pattern, which is different from the first light distribution pattern, is formed by combining the two partial light distribution patterns.

According to the embodiment, in an automotive headlamp in which a first light source and a second light source are arranged in a lamp chamber, a light distribution pattern having a shape in which two light distribution patterns are overlapped with each other can be formed by reflecting the light emitted from the second light source with a first reflector portion and a second reflector portion, while the second light source is being turned on.

BRIEF DESCRIPTION OF THE DRAWINGS

Embodiments will now be described, by way of example only, with reference to the accompanying drawings, which are meant to be exemplary, not limiting, and wherein like elements are numbered alike in several figures, in which:

FIG. 2 is a perspective view illustrating details of a light source portion in FIG. 1;

FIG. 3A is a schematic configuration view illustrating the arrangement of light sources and a reflector in a conventional two-wheeled vehicle headlamp;

FIG. 3B is a view illustrating a light distribution pattern formed, with the configuration illustrated in FIG. 3A, on a virtual vertical screen in front of a vehicle;

FIG. 9A is a schematic sectional view for explaining the internal structure of an automotive headlamp according to a second variation; and FIGS. 9B and 9C are views for explaining a light distribution pattern formed, on the virtual vertical screen, by the structure illustrated in FIG. 9A.

DETAILED DESCRIPTION OF THE INVENTION

The invention will now be described by reference to the preferred embodiments. This does not intend to limit the scope of the present invention, but to exemplify the invention.

Embodiment 1

Figure 1:
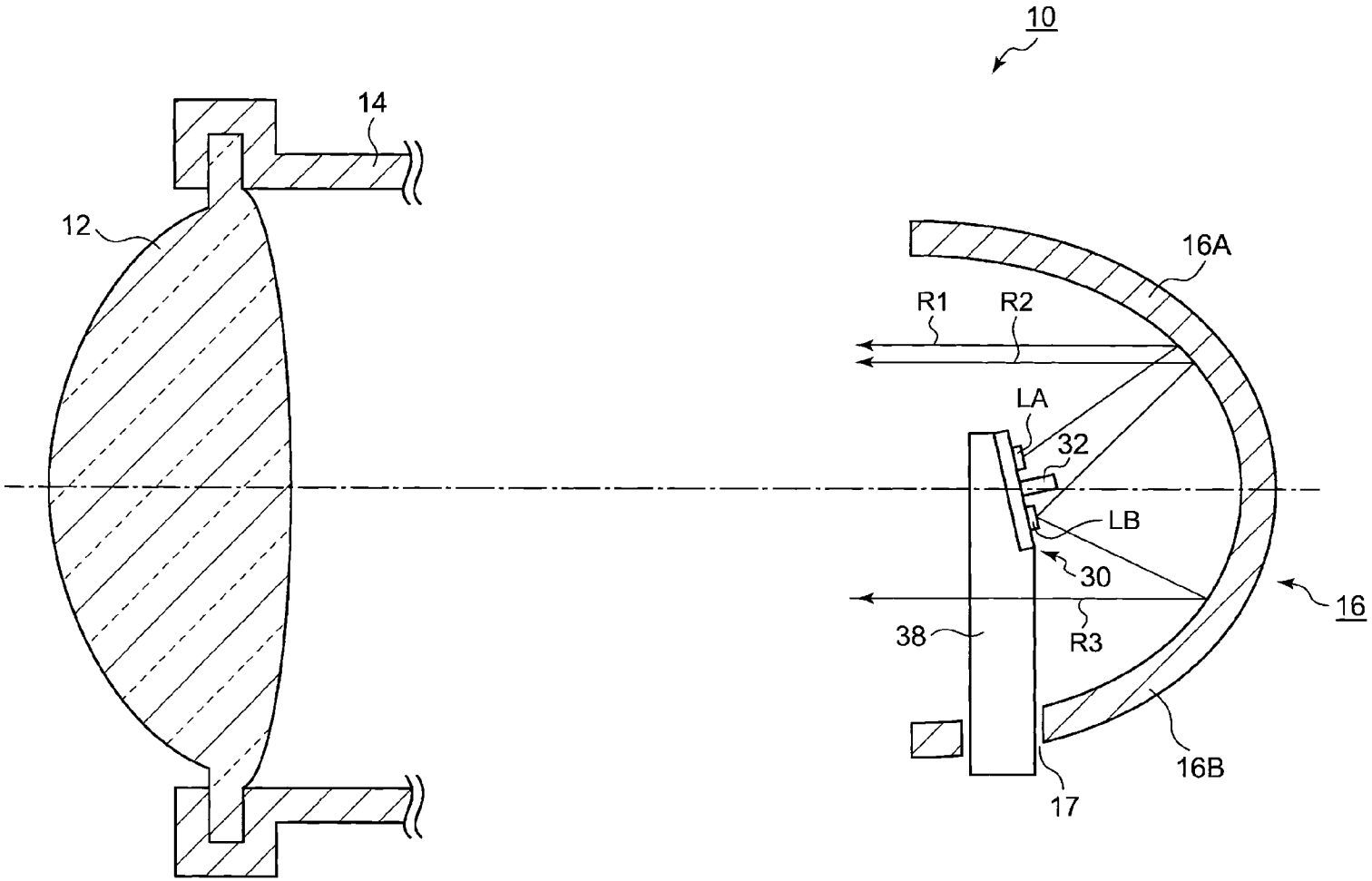
FIG. 1 is a schematic sectional view for explaining the internal structure of an automotive headlamp according to Embodiment 1.

FIG. 1 is a schematic sectional view for explaining the internal structure of an automotive headlamp 10 according to Embodiment 1. FIG. 1 illustrates the section of the automotive headlamp 10 cut by the vertical plane including the central axis of a lamp. The automotive headlamp 10 according to the present embodiment is an automotive headlamp mainly used for two-wheeled vehicles, which emits light so as to form, with a single lamp, predetermined light distribution patterns in front of a vehicle.

The automotive headlamp 10 mainly has a projection lens 12, a lens support member 14, a reflector 16, and a light source portion 30.

The projection lens 12 is arranged on the central axis extending in the longitudinal direction of a vehicle, and is supported by the lens support member 14 so as to cover the front opening of the reflector 16. The projection lens 12 is composed of a plano-convex aspheric lens whose front surface is convex-shaped, and projects a light source image that is formed on the back focal plane toward the front of the headlamp 10 as an inverted image. Hereinafter, description will be made based on a projected image formed on a virtual vertical screen arranged at the position, for example, 25 m away in front of a vehicle. It is needless to say that the virtual plane on which a projected image is formed is not limited to such a vertical plane, and, for example, a horizontal plane by which a road surface is supposed may be used.

The light source portion 30 includes two light sources consisting of a first light source LA and a second light source LB. It is preferable that the first light source LA and the second light source LB are both composed of light emitting diodes (LEDs); however, they may be composed of arbitrary lamps, such as halogen lamps, discharge lamps, or the like. The first light source LA and the second light source LB are light sources for forming, on the aforementioned virtual vertical screen, light distribution patterns each having a shape different from others. Examples of the shapes of the light distribution patterns will be described later. Each of the first light source LA and the second light source LB may be composed of one LED or multiple LEDs.

As illustrated in FIG. 1, an attachment 38 for fixing the light source portion 30 to a desired position has a structure extending in the vertical direction, and the light source portion 30 is installed by inserting the attachment 38 upward from a hole 17 provided in the lower portion of the reflector 16. By making the attachment 38 have such a shape extending vertically upward from the lower portion of the reflector 16, it becomes possible to make an influence by the existence of the attachment 38 on a light distribution pattern shape to be smaller than that occurring in the case where the attachment is inserted from another position.

The reflector 16 has a reflective surface formed as an approximately spheroidal curved surface and is arranged so as to be approximately face to face with each of the light sources LA and LB in the light source portion 30. The reflector 16 according to the present embodiment is composed of a first reflector portion 16A located above the central axis and a second reflector portion 16B located below the central axis. Each component is arranged such that the back focal point of the projection lens 12 is located at the first focal point of the spheroidal curved surface of the reflector and light source portion 30 is located at the second focal point thereof.

When the first reflector portion 16A and the second reflector portion 16B have the same focal point, it is made that the first light source LA and the second light source LB are arranged at or near the focal point position. Specifically, it is better to arrange the light source portion 30 such that the midpoint of the line segment connecting the first light source LA and the second light source LB approximately matches the focal point of the first reflector portion 16A and the second reflector portion 16B.

When the focal point of the first reflector portion 16A and that of the second reflector portion 16B are different from each other, the light source portion 30 is arranged such that the first light source LA is located at or near the focal point position of the first reflector portion 16A and the second light source LB is located at or near the that of the second reflector portion 16B.

The first reflector portion 16A and the second reflector portion 16B are configured to have reflective properties different from each other. That is, the first reflector portion 16A is configured to reflect the light emitted from each of the first light source LA and the second light source LB toward the projection lens 12, as illustrated by Arrows R1 and R2 in FIG. 1. On the other hand, the second reflector portion 16B is configured to reflect the light emitted from the second light source LB toward the projection lens 12, as illustrated by Arrow R3.

In order to achieved what has been stated above, the light source portion 30 is installed such that the normal line, penetrating the surface of the substrate 34 on which the first light source LA and the second light source LB are arranged and extending toward the reflector, is directed above the central axis (inclined in the direction of the first reflector portion 16A). In addition, a light-shielding plate 32 is arranged between the first light source LA and the second light source LB. This will be described later with reference to FIG. 2.

Control of turning on/off the first light source LA and the second light source LB is performed by a control unit (not illustrated) that has been installed as part of the automotive headlamp 10 or provided outside the automotive headlamp 10.

In the example illustrated in FIG. 1, it is configured such that the reflective surface of the first reflector portion 16A and that of the second reflector portion 16B are smoothly continued to each other; however, the first reflector portion 16A and the second reflector portion 16B may not be continued to each other, or a step maybe located between them. In addition, it is not necessarily needed that the boundary between the first reflector portion 16A and the second reflector portion 16B matches the central axis, and accordingly the first reflector portion 16A or the second reflector portion 16B may extend beyond the central axis.

FIG. 2 is a perspective view illustrating details of the light source portion 30 in FIG. 1. As stated above, the first light source LA and the second light source LB are arranged on the common substrate 34. The light-shielding plate 32, extending toward the direction in which light is emitted from each light source, is provided between the first light source LA and the second light source LB. This light-shielding plate 32 is arranged at a height where the light emitted from the first light source LA is shielded such that all or most of the light emitted therefrom does not reach the second reflector portion 16B.

In FIG. 2, the first light source LA and the second light source LB are arranged approximately symmetrically with respect to the light-shielding plate 32. However, it is not needed that the first light source LA and the second light source LB are symmetrically arranged, and the positions thereof are determined based on the positional relationship between the reflector 16 and the light source portion 30 or on the size of a light distribution pattern to be formed on the virtual vertical screen, etc. In addition, all of the first light source LA, the second light source LB, and the light-shielding plate 32 are arranged on the single substrate 34 in FIG. 2; however, the first light source LA and the second light source LB may be arranged on separate substrates and a light-shielding plate by which the two substrates are divided from each other may be provided separately.

Referring again to FIG. 1, operations of the automotive headlamp 10 will be described.

As stated above, the light source portion 30 and the reflector 16 are arranged to have such a positional relationship that: the light emitted from the second light source LB is reflected by both the first reflector portion 16A and the second reflector portion 16B, while the light emitted from the first light source LA is reflected only by the first reflector portion 16A. In order to achieve this, the light-shielding plate 32 for preventing the light emitted from the first light source LA from entering the second reflector portion 16B is provided between the first light source LA and the second light source LB. In addition, the substrate 34 is arranged in an inclined manner such that the normal line, extending toward the reflector 16 from the substrate 34 on which the first and second light sources have been mounted, is directed above the central axis. By inclining the substrate in such a way, the light emitted from the second light source LB is likely to be reflected by the first reflector portion 16A.

In another embodiment, the substrate 34 may be arranged such that the midpoint between the first light source LA and the second light source LB is located vertically above the central axis, instead of being arranged so as to be inclined with respect to the central axis. With such arrangement, the light emitted from the second light source LB is likely to be reflected by the first reflector portion 16A.

The reason why a configuration in which the light emitted from one of the two light sources is reflected by both the first reflector portion and the second reflector portion is adopted is as follows.

FIG. 3A is a schematic configuration view illustrating the arrangement of light sources 60A and 60B and a reflector 62 in a conventional two-wheeled vehicle headlamp. The light emitting surfaces of the two light sources 60A and 60B are arranged in the directions in which the light emitting surfaces are face to face with the reflector 62. In order to make a horizontal cut-off line in a light distribution pattern for low beam, the upper light source 60A is arranged such that the central axis of the headlamp is placed near the lower end of the light source 60A. The lower light source 60B is arranged so as to be spaced apart, by a predetermined interval in the vertical direction, from the upper light source 60A. The light emitted from the upper light source 60A is reflected by the upper portion of the reflector 62, and the light emitted from the lower light source 60B is reflected by the lower portion of the reflector 62. FIG. 3B illustrates a light distribution pattern for low beam 64A and a light distribution pattern for high beam 64B that are formed, by the configuration illustrated in FIG. 3A, on a virtual vertical screen in front of a vehicle.

In the aforementioned configuration, when the upper portion and the lower portion of the reflector 62 have structures symmetrical to each other, the light distribution pattern for high beam 64B formed by being reflected by the lower portion of the reflector and the light distribution pattern for low beam 64A formed by being reflected by the upper portion thereof, become patterns inverted vertically with respect to each other, as illustrated in FIG. 3B. Because the upper and lower light sources 60A and 60B are arranged so as to be spaced apart from each other, an interval is made between the two light distribution patterns 64A and 64B. In light distribution patterns for high beam of automotive headlamps, it is generally demanded that light flux is concentrated near the intersection between a horizontal line (H) and a vertical line (V); however, light flux cannot be concentrated there in the configuration as in FIG. 3A.

Accordingly, it has been made in the present embodiment that a light distribution patter for high beam is formed by reflecting the light emitted from the second light source LB located below the central axis with each of the first reflector portion 16A and the second reflector portion 16B of the reflector 16 and by combining the two patterns projected on the virtual vertical screen. Thereby, it becomes possible to concentrate, to the highest level, light flux near the center. This can be understood more clearly by the light distribution pattern view of FIG. 4.

Figure 4:
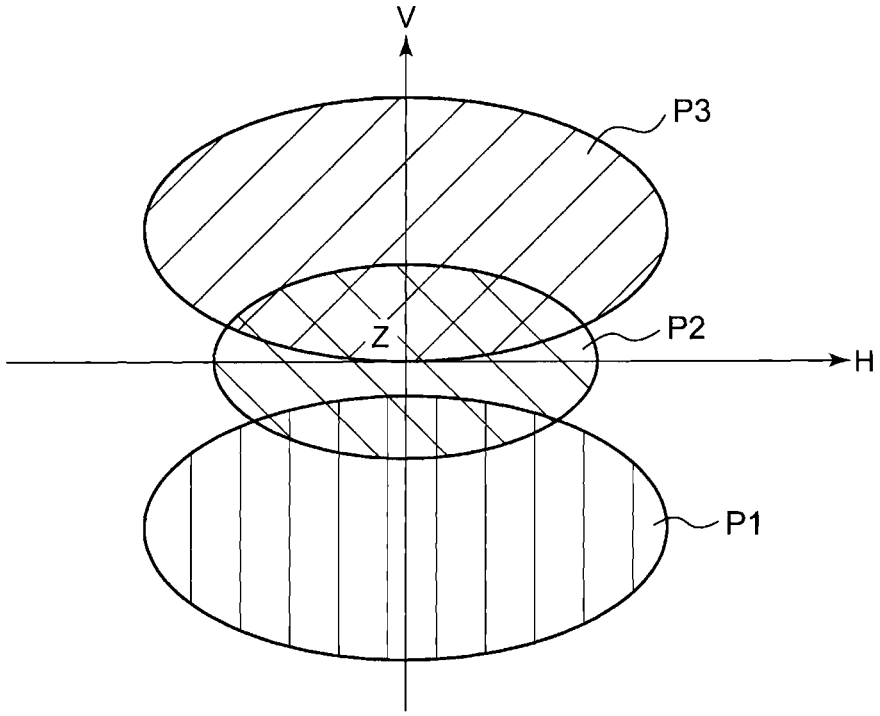
FIG. 4 is a view for explaining a light distribution pattern formed, by the automotive headlamp in FIG. 1, on the virtual vertical screen.

FIG. 4 is a view for explaining a light distribution pattern formed, on the virtual vertical screen, by the automotive headlamp 10 in FIG. 1. As stated above, because the light emitted from the first light source LA is reflected only by the first reflector portion 16A, one pattern is projected on the screen while the first light source LA is being turned on. On the other hand, because the light emitted from the second light source LB is reflected by both the first reflector portion 16A and the second reflector portion 16B, two individual patterns are simultaneously projected on the screen while the second light source LB is being turned on.

More specifically, a pattern P1 is a light distribution pattern formed by the light that has been emitted from the first light source LA and reflected by the first reflector portion 16A. A pattern P3 is a light distribution pattern formed by the light that has been emitted from the second light source LB and reflected by the first reflector portion 16A. A pattern P2 is a light distribution pattern formed by the light that has been emitted from the second light source LB and reflected by the second reflector portion 16B.

The pattern P1 is formed while the first light source LA is being turned on. The patter P1 is suitable for a light distribution pattern for low beam because it is formed below the horizontal line.

A light distribution pattern having an almost figure 8-like shape as a whole (illustrated by the heavy lines in the view), in which the pattern P2 and the pattern P3 are combined together, is formed while the second light source LB is being turned on. At the time, the checked area Z in the view has an illuminance higher than other areas because both the pattern P3 and the pattern P2 are overlapped with each other there. By configuring an automotive headlamp such that the checked area is located near the intersection between the horizontal line and the vertical line, a pattern can be formed in which the region near the intersection can be lighted up with a high illuminance and light is emitted toward a wide range. Accordingly, the light distribution pattern formed while the second light source LB is being turned on is suitable for a light distribution pattern for high beam.

As known from FIG. 4, it is preferable that the second light source LB is arranged with respect to the reflector such that, of the light emitted from the second light source LB while it is being turned on, the area of a portion (pattern P3) formed by the light reflected with the first reflector portion 16A being projected is larger than that of a portion (pattern P2) formed by the light reflected with the second reflector portion 16B being projected. Thereby, the irradiated area above the horizontal line can be made larger, and hence a light distribution pattern formed while the second light source LB is being turned on can be made to be more suitable for high beam.

According to Embodiment 1, a plurality of light distribution patterns can be formed with a single lamp by using an automotive headlamp in which two light sources are arranged in a lamp chamber, as described above. Further, by reflecting the light emitted from one of the two light sources with both the upper portion and the lower portion of a reflector, a pattern having a high illuminance, in which the two light distribution patterns are overlapped with each other, can be formed while the light source is being turned on.

Although a projector type automotive headlamp has been described in FIG. 1, the present embodiment can also be applied to a parabola type automotive headlamp.

Figure 5:
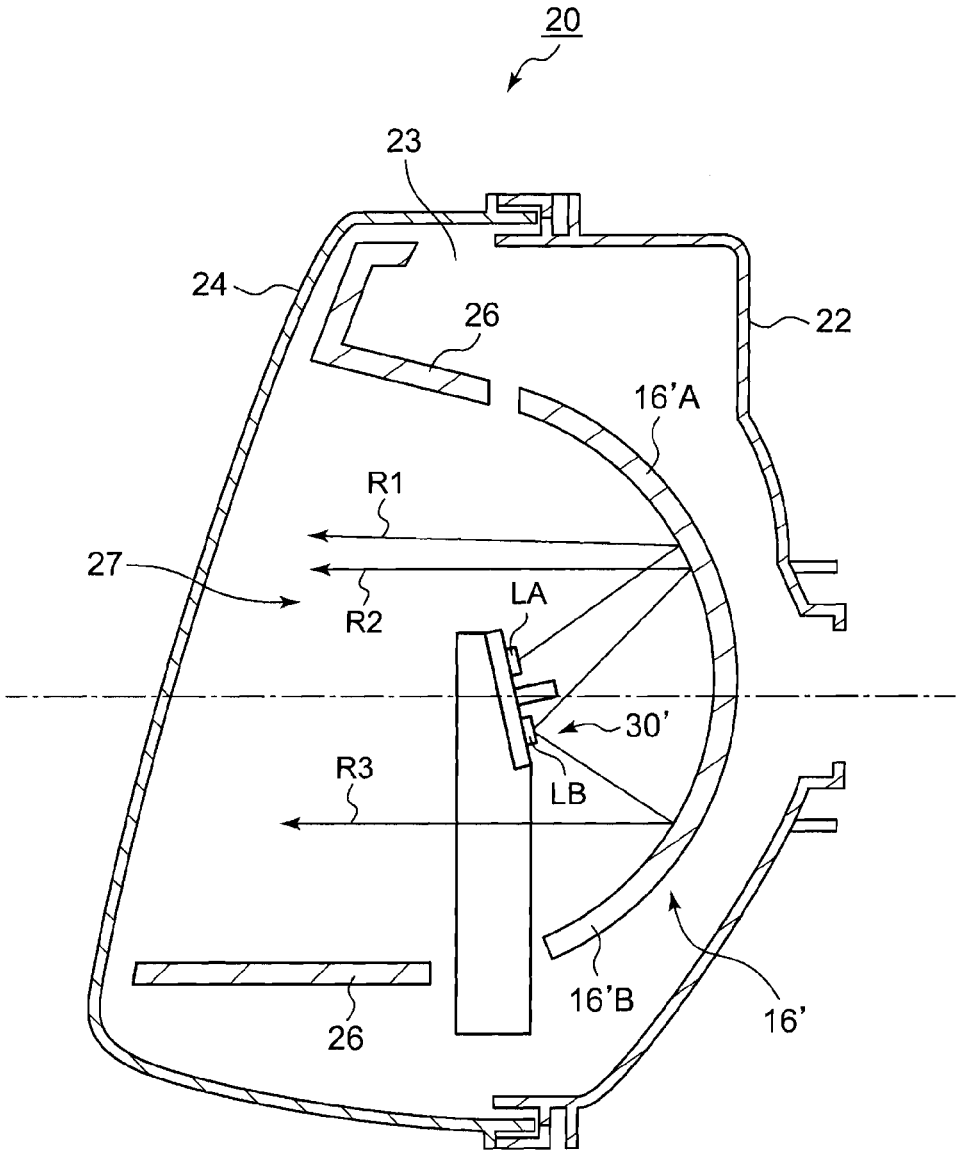
FIG. 5 is a view illustrating a parabola type automotive headlamp to which Embodiment 1 has been applied.

FIG. 5 is a schematic sectional view for explaining the internal structure of a parabola type automotive headlamp 20 to which the present embodiment has been applied. FIG. 5 illustrates the section of the automotive headlamp 20 cut by the vertical plane including the central axis of a lamp. The automotive headlamp apparatus 20 has a configuration in which a lamp unit 27 has been housed in a lamp chamber 23 formed by a lamp body 22 and a translucent cover 24 attached to the front end opening of the lamp body 22. The lamp is supported in the lamp chamber 23 by a non-illustrated support member. In addition, an extension member 26 having an opening in an area where the lamp is located is fixed to the lamp body 22 or the translucent cover 24, thereby covering, with respect to the front, the area between the front opening of the lamp body 22 and the lamp.

The lamp unit 27 has a light source portion 30' and a reflector 16'. Because the light source portion 30' has the same configuration as the light source portion 30 described in FIG. 1, detailed description thereof will be omitted. The reflector 16' has a reflective surface formed as an approximately paraboloid of revolution, and is arranged so as to be approximately face to face with each of light sources LA and LB in the light source portion 30'. Similarly in FIG. 1, the reflector 16' is composed of a first reflector portion 16'A located above the central axis and a second reflector portion 16'B located below the central axis.

Other configurations and light distribution patterns formed on a virtual vertical screen while a first light source or a second light source is being turned on, are the same as what have been described in FIGS. 1, 2, and 4.

Embodiment 2

Figure 6:
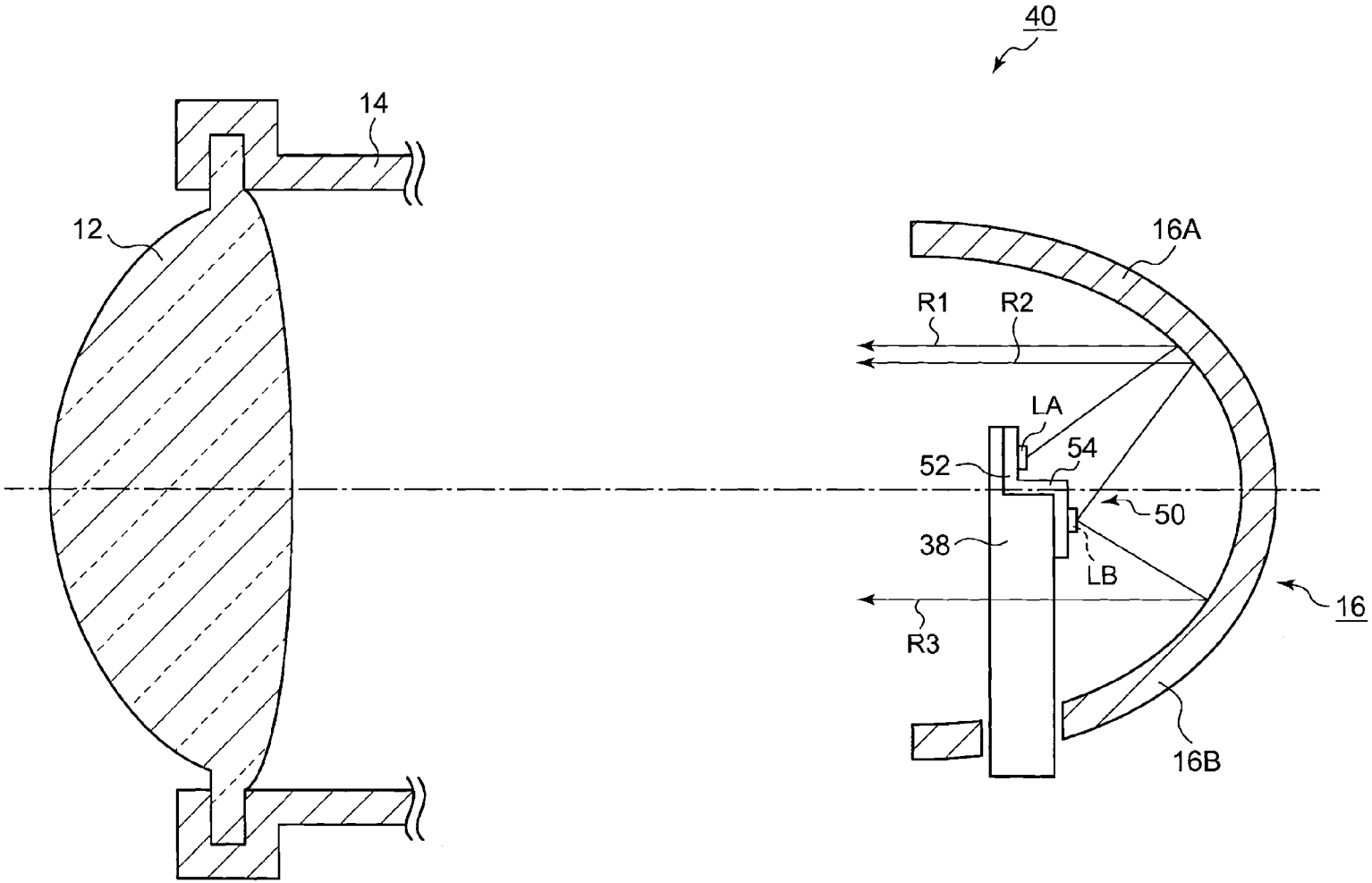
FIG. 6 is a schematic sectional view for explaining the internal structure of an automotive headlamp according to Embodiment 2.

FIG. 6 is a schematic sectional view for explaining the internal structure of an automotive headlamp 40 according to Embodiment 2. The automotive headlamp 40 has the same configuration as that of the automotive headlamp 10 described in FIG. 1, except a light source portion 50.

In Embodiment 2, the light source portion 50 comprises a stepwise substrate 52 in order to arrange a first light source LA and a second light source LB at positions having different distances from a reflector 16. The first light source LA is arranged, with respect to the reflector 16, on the front side of a lamp, and the second light source LB is arranged, with respect to the reflector 16, on the protrusion side thereof. By configuring the substrate 52 so as to be stepwise, a shape is formed in which a step portion 54 extends in the lateral direction (right side in the view) of the first light source LA. Thereby, the step portion 54 also functions as a light-shielding plate for shielding the light emitted from the first light source LA toward the lower right direction in the view.

All or most of the light emitted from the first light source LA does not reach the second reflector portion 16B due to the light-shielding function of the step portion 54. Accordingly, the light emitted from the second light source LB is reflected by both the first reflector portion 16A and the second reflector portion 16B, while the light emitted from the first light source LA is reflected only by the first reflector portion 16A, similarly to Embodiment 1. The light reflected by the first reflector portion 16A and the second reflector portion 16B are projected in front of a vehicle through a projection lens 12.

As a result of the aforementioned configuration, the automotive headlamp 40 can project, while the first light source LA is being turned on, a light distribution pattern suitable for a light distribution pattern for low beam, and can project, while the second light source LB is being turned on, a light distribution pattern suitable for a light distribution pattern for high beam, similarly to Embodiment 1.

Figure 7:
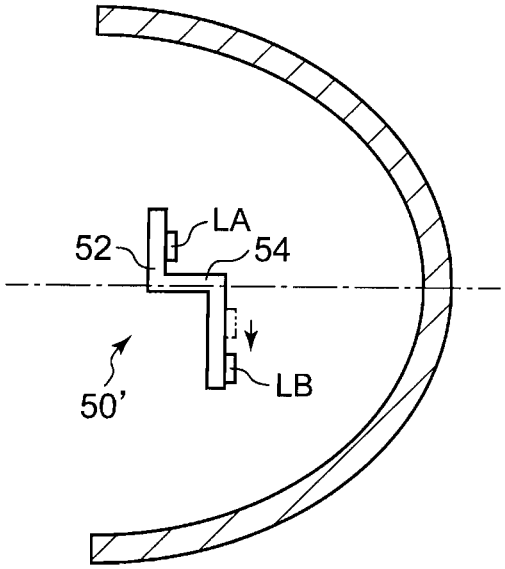
FIG. 7 is a view illustrating a structure in which the distance between a second light source and the central axis is made to be larger than that between a first light source and the central axis.

As illustrated in FIG. 7, the distance between the second light source LB and the central axis may be larger than that between the first light source LA and the central axis. Thereby, the pattern (pattern P3 in FIG. 4) formed by projecting the light that is emitted from the second light source LB and reflected by the first reflector portion 16A, can be enlarged. By changing the vertical position of the second light source LB in this way, the irradiated area formed when a high beam is selected can be adjusted.

According to Embodiment 2, a plurality of light distribution patterns can be formed with a single lamp by using an automotive headlamp in which two light sources are arranged in a lamp chamber, as described above and similarly to Embodiment 1. By reflecting the light emitted from one of the two light sources with both the upper portion and the lower portion of a reflector, a pattern having a high illuminance, in which the two light distribution patterns are overlapped with each other, can be formed while the light source is being turned on.

Although a projector type automotive headlamp has been described in FIG. 6, the present embodiment can also be applied to a parabola type automotive headlamp.

It has been described in the aforementioned embodiments that, in an automotive headlamp comprising two light sources in a lamp chamber, a pattern formed while one of the two light sources is being turned on is used as a light distribution pattern for low beam, and a pattern formed while the other light source is being turned on is used as a light distribution pattern for high beam. In addition to this, various patterns described below can be combined.

A pattern formed while the first light source LA is being turned on is used as a light distribution pattern for low beam, and a pattern formed while the second light source LB is being turned on is used as a DRL (Daytime Running Lamp).

The first light source LA may be composed of a white light source and the second light source LB may be composed of an infrared light source such that a pattern formed while the first light source LA is being turned on is used as a light distribution pattern for white low beam and a pattern formed while the second light source LB is being turned on is used as an infrared light pattern for emitting light toward a wider range. The infrared light pattern can be applied to various applications. As one example of that, it can be applied to a night vision system for showing obstacles in front of a vehicle at night time running or to a lane following system for allowing a vehicle to run along the white line on a road by detecting the line, etc.

An automotive headlamp may be configured to form three types of light distribution patterns by switching the lighting of the first light source LA alone, that of the second light source LB alone, and that of both the light sources. Describing this by taking the light distribution pattern view in FIG. 4 as an example, the light distribution pattern P1 formed while the first light source LA is being turned on may be used as a light distribution pattern for low beam; a combination of the light distribution patterns (P2+P3) formed while the second light source LB is only being turned on may be used as a light distribution pattern for high beam; and a combination of the light distribution patterns (P1+P2+P3) formed while both the first and the second light sources are being turned on may be used as a DRL.

In the aforementioned embodiments, it has been described that a light distribution pattern for low beam and that for high beam are formed by the lighting of the first light source LA and that of the second light source LB. However, there is a problem in this case, in which, in a light distribution pattern for high beam formed while a second light source is being turned on, the illuminance at the center of the pattern is increased by the overlap of two types of light reflected with two reflector, but in a light distribution pattern for low beam formed while a first light source is being turned on, the illuminance at the center thereof is not increased, and accordingly the illuminance near the center is lower than that in the light distribution pattern for high beam.

Therefore, it may be made to change the luminance of the first light source LA and the second light source LB, in addition to the aforementioned configuration. For example, a light emitting element, having a luminance higher than the second light source LB for forming a light distribution pattern for high beam, may be used for the first light source LA for forming a light distribution pattern for low beam. Alternatively, when the same light emitting elements are used in the first light source LA and the second light source LB, the power to be supplied to the first light source LA may be set to be higher than that to be supplied to the second light source LB. Alternatively, the number of the light emitting elements in the first light source LA may be larger than that in the second light source LB. With such configurations, the difference in the illuminance of a light distribution pattern for low beam and that for high beam, occurring near the intersection between the horizontal line and the vertical line, can be made small.

The present invention also includes the following embodiments.

1. Automotive headlamp in which a first light distribution pattern is a light distribution pattern for low beam and a second light distribution pattern is a light distribution pattern for high beam.

2. Automotive headlamp in which a first light distribution pattern is a light distribution pattern for low beam and a second light distribution pattern is a light distribution pattern for a DRL.

In the aforementioned embodiments, it has been described that two light distribution patterns different from each other in the vertical direction are formed by arranging two light sources in a lamp chamber and by reflecting the light emitted from one of the two light sources with both the upper portion and the lower portion of a reflector. Alternatively, two light distribution patterns different from each other in the horizontal direction may be formed by dividing a reflector into a left portion and a right portion and by reflecting the light emitted from one of the two light sources with both the divided reflector portions. In this case, the automotive headlamp may be mounted in a four-wheeled vehicle.

Figure 8A:
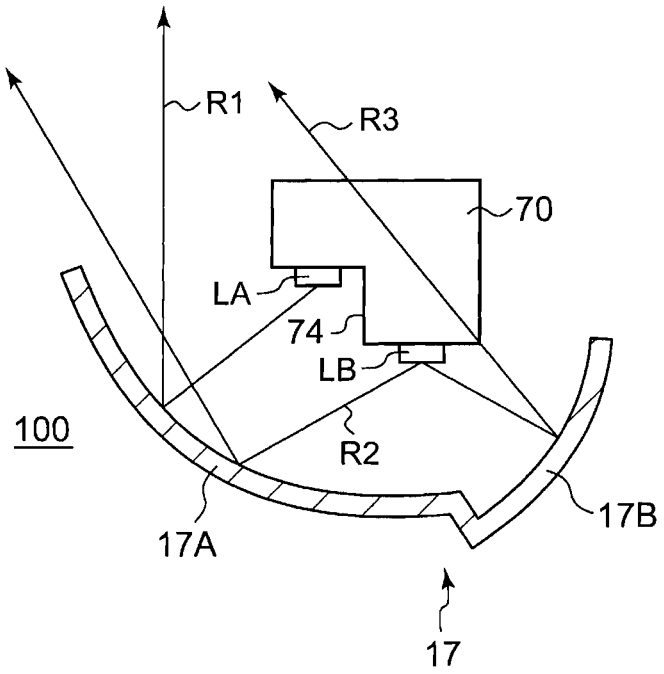
FIG. 8A is a schematic sectional view for explaining the internal structure of an automotive headlamp according to a first variation.

FIG. 8A is a view for explaining a first variation of this structure. FIG. 8A illustrates the section of an automotive headlamp 100 cut by the horizontal plane including the central axis of a lamp, the headlamp 100 being to be mounted in the front left portion of a vehicle (hereinafter, referred to as a "left lamp"). An automotive headlamp to be mounted in the front right portion of the vehicle (hereinafter, referred to as a "right lamp") is formed to be symmetrical to this. A light source portion 70 including a first light source LA and a second light source LB has a stepwise configuration. A reflector 17 is composed of a first reflector portion 17A and a second reflector portion 17B, each of which has a reflective surface to be formed as an approximately rotary paraboloidal curved surface. The boundary between the first reflector portion 17A and the second reflector portion 17B is arranged at a position shifted right from the intermediate line of the first light source LA and the second light source LB.

The first light source LA is arranged, with respect to the reflector 17, on the front side of the lamp, and the second light source LB is arranged, with respect to the reflector 17, on the protrusion side thereof. By configuring the light source portion 70 so as to be stepwise, a shape is formed in which a step portion 74 extends in the lateral direction of the first light source LA (lower side in the view). Thereby, the step portion 74 also functions as a light-shielding plate for shielding the light emitted from the first light source LA toward the lower right direction in the view.

Figure 8B:
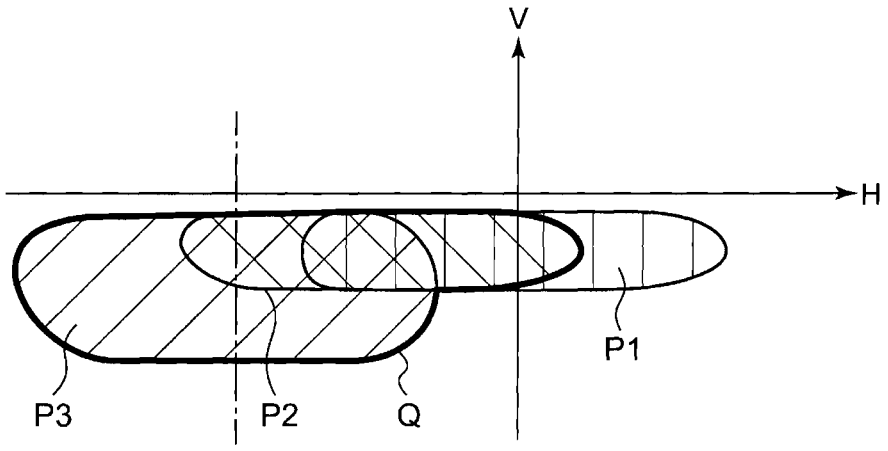
FIG. 8B is a view for explaining a light distribution pattern formed, on the virtual vertical screen, by the structure illustrated in FIG. 8A.

FIG. 8B is a view for explaining the light distribution pattern formed, by the automotive headlamp 100 in FIG. 8A, on the virtual vertical screen. The light emitted from the first light source LA is reflected only by the first reflector portion 17A, as illustrated by Arrow R1 in FIG. 8A, to form a pattern P1. The light emitted from the second light source LB is reflected by the first reflector portion 17A, as illustrated by Arrow R2, to form a pattern P2 on the screen, and also reflected by the second reflector portion 17B, as illustrated by Arrow R3, to form a pattern R3 on the screen.

A pattern formed while the first light source LA is being turned on is used as a light distribution pattern for low beam. On the other hand, a light distribution pattern Q having an irregular shape (illustrated by the heavy lines in the view), which has been formed by combining the pattern P2 and the pattern P3, is formed while the second light source LB is being turned on. The light distribution pattern Q goes too far to the horizontal left in comparison with the light distribution pattern for low beam. Accordingly, the pattern Q can be used as a cornering lamp for emitting light in the lateral direction of a vehicle when the vehicle turns. The left lamp 100 in FIG. 8A is mounted in the front left portion of a vehicle and the light distribution pattern Q goes too far to the horizontal left, the pattern Q is used as a cornering lamp when the vehicle turns left while the second light source is being turned on. On the contrary, the non-illustrated right lamp is used as a cornering lamp when a vehicle turns right while the second light source us being turned on.

A similar effect can be obtained when the aforementioned left lamp and right lamp are mounted in the front right portion and front left portion of a vehicle, respectively.

By applying a variation, such as one described above, a low beam and a cornering lamp can be properly used with a pair of (i.e., each of a left and a right) headlamps.

The left and right pair of headlamps described in the aforementioned variation can be applied to other applications other than a combination of a low beam and a cornering lamp. For example, the pattern formed while the first light source LA is being turned on may be used as a light distribution pattern for low beam, and the pattern formed while the second light source LB is being turned on may be used as a bending lamp. Alternatively, the former pattern may be used as a light distribution pattern for low beam and the latter pattern be used as a clearance lamp (front position lamp). Alternatively, the former pattern may be used as a light distribution pattern for low beam and the latter pattern may be used as a decorative lamp.

Three light sources may be arranged in a lamp chamber such that the light emitted from one of the three light sources is respectively reflected by a plurality of divided reflectors.

FIG. 9A is a view for explaining such a second variation. FIG. 9A illustrates the section of an automotive headlamp (hereinafter, referred to as a "left headlamp") 110 cut by the horizontal plane including the central axis of the lamp. A light source portion 80 including a first light source LA, a second light source LB, and a third light source has an approximately concave configuration as a whole. The first light source LA is mounted in the concave portion at the center of the light source portion 80. The second light source LB and the third light source LC are respectively mounted in the portions on both sides of the first light source LA, the portions protruding with respect to a reflector 19.

The reflector 19 is composed of a first reflector portion 19A, a second reflector portion 19B, and a third reflector portion 19C, each of which has a reflective surface to be formed as an approximately paraboloid of revolution. The first reflector portion 19A, the second reflector portion 19B, and the third reflector portion 19C are arranged so as to be face to face with the first light source LA, the second light source LB, and the third light source LC, respectively.

By configuring the light source portion 80 into an approximately concave shape, a step portion 84 extends on both sides of the first light source LA (lower direction in the view) mounted in the concave portion. Thereby, the step portion 84 also functions as a light-shielding plate for shielding the light emitted from the first light source LA toward the lower right direction and the lower left direction in the view.

FIGS. 9B and 9C are views for explaining a light distribution pattern formed, by the automotive headlamp 110, on a virtual vertical screen. The light emitted from the first light source LA is reflected only by the first reflector portion 19A, as illustrated by Arrow R1 in FIG. 9A, to form a pattern P1 on the screen.

The light emitted from the second light source LB is reflected by the first reflector portion 19A, as illustrated by Arrow R2, to form a pattern P2 on the screen, and also reflected by the second reflector portion 19B, as illustrated by Arrow R3, to form a pattern P3 on the screen.

The light emitted from the third light source LC is reflected by the first reflector portion 19A, as illustrated by Arrow R4, to form a pattern P4 on the screen, and also reflected by the third reflector portion 19C, as illustrated by Arrow R5, to form a pattern P5 on the screen.

The pattern formed while the first light source LA is being turned on is used as a light distribution pattern for low beam. On the other hand, a light distribution pattern Q1 having an irregular shape (illustrated by the heavy lines in FIG. 9B), which has been formed by combining the pattern P2 and the pattern P3, is formed while the second light source LB is being turned on. This light distribution pattern goes too far to the horizontal right in comparison with the light distribution pattern for low beam. Accordingly, the pattern can be used as a cornering lamp when a vehicle turns right. Further, a light distribution pattern Q2 having an irregular shape (illustrated by the heavy lines in FIG. 9C), which has been formed by combining the pattern P4 and the pattern P5, is formed while the third light source LC is being turned on. This light distribution pattern goes too far to the horizontal left in comparison with the light distribution pattern for low beam. Accordingly, the pattern can be used as a cornering lamp when a vehicle turns left.

In the second variation in FIG. 9A, three light distribution patterns including a light distribution pattern for low beam, that for cornering when a vehicle turns right, and that for cornering when a vehicle turns left, can be emitted with a single automotive headlamp by switching three light sources for emitting light, as stated above.

What is claimed is:

1. An automotive headlamp comprising:

a reflector composed of a first reflector portion and a second reflector portion;

a light source composed of a first light source and a second light source that are located at or near the focal point of the reflector; and a light-shielding part installed between the first light source and the second light source, wherein the light-shielding part is arranged to prevent the light emitted from the first light source from being incident on the second reflector portion and not to prevent the light emitted from the second light source from being incident on the first and second reflector portions, wherein the first light source and the second light source are arranged such that: the light emitted from the first light source is reflected by the first reflector portion to form a first light distribution pattern; a first portion of the light emitted from the second light source forms a first partial light distribution pattern by being reflected by the first reflector portion and not by the second reflector portion; a second portion of the light emitted from the second light source forms a second partial light distribution pattern which is different from the first partial light distribution pattern by being reflected by the second reflector portion and not by the first reflector portion, and a second light distribution pattern, which is different from the first light distribution pattern, is formed by combining the first and second partial light distribution patterns, and wherein the first light source and the second light source can be turned on individually, and the first light distribution pattern is formed while the first light source is being turned on and the second light distribution pattern is formed while the second light source is being turned on.

2. The automotive headlamp according to claim 1, wherein the first reflector portion is located above the central axis extending in the longitudinal direction of a vehicle, and the second reflector portion is located below the central axis.

3. The automotive headlamp according to claim 1, wherein the light source is arranged such that the projected area of the light that is emitted from the second light source and reflected by the first reflector portion is larger than that of the light that is emitted from the second light source and reflected by the second reflector portion.

4. The automotive headlamp according to claim 1, wherein the first light source and the second light source are arranged on the same substrate, and the normal line of the substrate surface on which the light sources are arranged is installed to be inclined toward the first reflector portion with respect to the central axis.

5. The automotive headlamp according to claim 1, wherein the light-shielding part comprises a step provided between the surface on which the first light source is arranged and the surface on which the second light source is arranged, so that the second light source protrudes toward the reflector.

* * * * *